United States Patent [19]

Bellanca et al.

[11] 3,949,719

[45] Apr. 13, 1976

[54] VOLUMETRIC CONTROL VALVE UNIT FOR CRANKCASE VENTILATION SYSTEM

[75] Inventors: Joseph M. Bellanca, Woodstock; Lewis D. Sargert, Addison; Rodney M. Antrim, Arlington Heights, all of Ill.

[73] Assignee: Kar Products Inc., Des Plaines, Ill.

[22] Filed: Jan. 27, 1975

[21] Appl. No.: 544,146

[52] U.S. Cl. ..... 123/119 B; 123/41.86; 137/480

[51] Int. Cl.[2] ..... F01M 13/00

[58] Field of Search ..... 123/119 B, 41.86; 137/480

[56] References Cited

UNITED STATES PATENTS

| | | | |
|---|---|---|---|
| 2,386,765 | 10/1945 | Adams | 123/119 B |
| 3,108,581 | 10/1963 | Humphreys | 123/119 B |
| 3,181,833 | 5/1965 | Adams | 123/119 B |
| 3,463,132 | 8/1969 | Krieck | 123/119 B |
| 3,877,451 | 4/1975 | Lipscomb | 123/119 B |

*Primary Examiner*—Charles J. Myhre
*Assistant Examiner*—R. H. Lazarus
*Attorney, Agent, or Firm*—Johnson, Dienner, Emrich & Wagner

[57] ABSTRACT

The control valve unit includes a vertical tubular member mounted at its upper end in the outlet opening of a filter unit incorporated in an internal combustion engine crankcase ventilation system. The tubular member is formed with slot means restricting the flow of vapors through the control valve unit. The lower end of the tubular member is provided with valve seat means upon which is normally seated a ball valve. The ball valve is unseated from the valve seat means under predetermined conditions.

7 Claims, 6 Drawing Figures

VOLUMETRIC CONTROL VALVE UNIT FOR CRANKCASE VENTILATION SYSTEM

FIELD OF THE INVENTION

The present invention relates generally to a crankcase ventilation system for an internal combustion engine of the type used in stationary installations or in large mobile equipment such as earth moving machines, cranes and the like, and more particularly to a volumetric control valve which is incorporated in the ventilation system and which restricts the flow of vapors therethrough.

SUMMARY OF THE INVENTION

The crankcase ventilation system of the present invention is associated with an internal combustion engine having a crankcase and an intake manifold. The system includes a filter unit defining a condensation filtration chamber and having an upper outlet opening. Inlet conduit means accommodates the flow of vapors from the crankcase to the condensation filtration chamber, while outlet conduit means accommodates the flow of vapors from the outlet opening to the intake manifold.

Arranged within the condensation filtration chamber is a volumetric control valve unit for metering the flow of vapors between the condensation filtration chamber and the outlet opening. The control valve unit includes a vertical tubular member mounted at its upper end in the outlet opening. The tubular member is formed with slot means adjacent the upper end thereof to provide first passageway means restricting the flow of vapors through the control valve unit and presenting a metering area corresponding to a predetermined value of pressure (either negative or positive) desired in the crankcase under normal operating conditions. The lower end of the tubular member is provided with valve seat means upon which, within the tubular member, is normally seated a ball valve. The ball valve is unseated from the valve seat means when the pressure in the crankcase exceeds the predetermined value of pressure to provide additional passageway means for the flow of vapors through the control valve unit. The operation of the ball valve automatically compensates for changes in the crankcase pressure and serves to maintain the crankcase pressure substantially at the predetermined value.

In one embodiment of control valve unit, the ball valve is normally seated on the valve seat means by gravity alone. In another embodiment of control valve unit, spring means are employed to positively bias the ball valve into seating engagement with the valve seat means.

DESCRIPTION OF THE PREFERRED EMBODIMENTS

Figure 1:
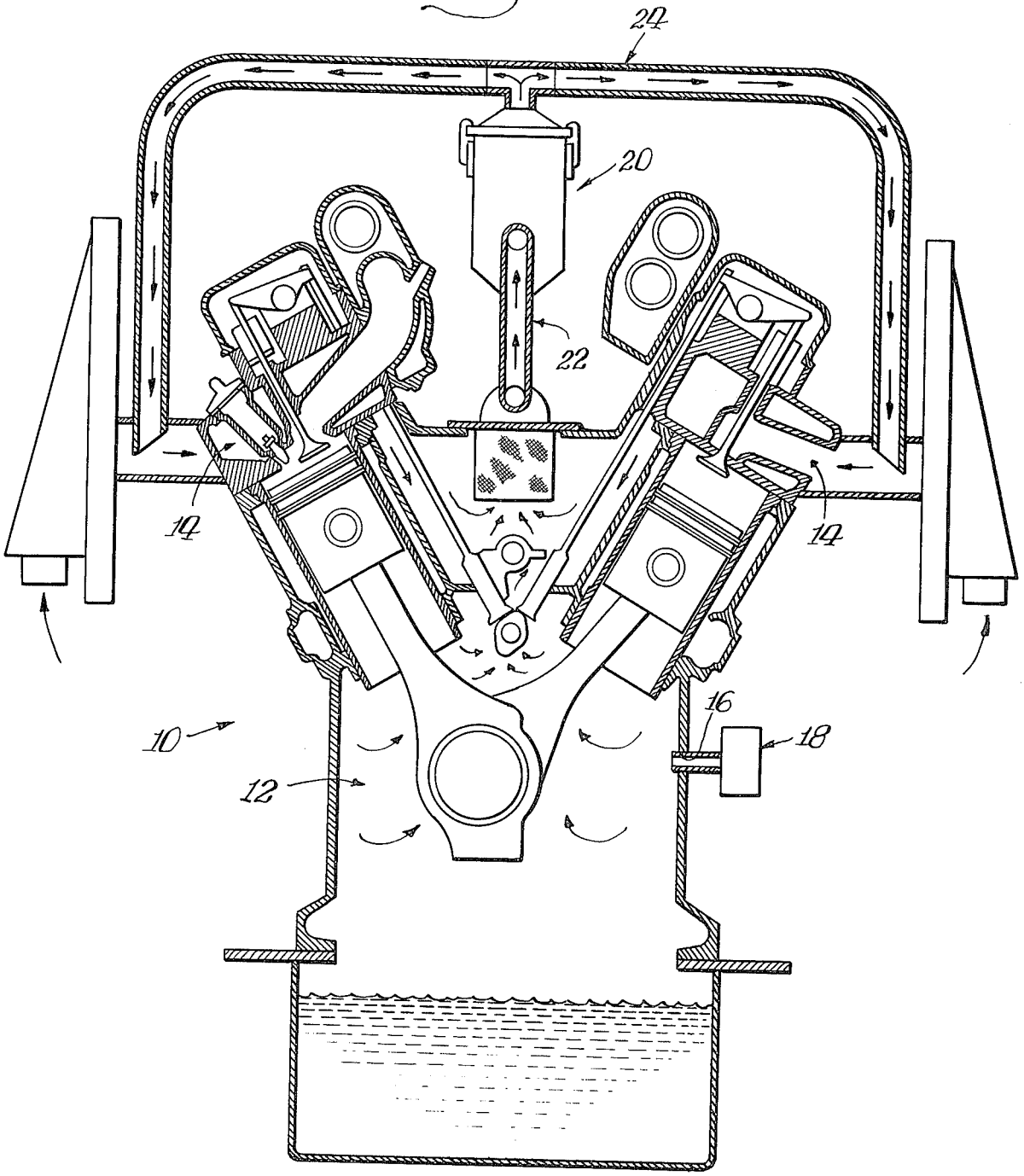
FIG. 1 is a transverse sectional view of an internal combustion engine and the crankcase ventilation system of the present invention.

Referring now to FIG. 1, there is shown a conventional internal combustion engine 10 having a crankcase 12 and intake manifolds 14. The crankcase 12 is formed with a side opening 16 in which is mounted a fresh-air inlet filter unit 18.

Associated with the engine 10 is a crankcase ventilation system which includes a filter unit 20. Inlet conduit means 22 accommodates the flow of vapors from the crankcase 12 to the filter unit 20. Outlet conduit means 24 accommodates the flow of vapors from the filter unit 20 to the manifolds 14.

Figure 2:
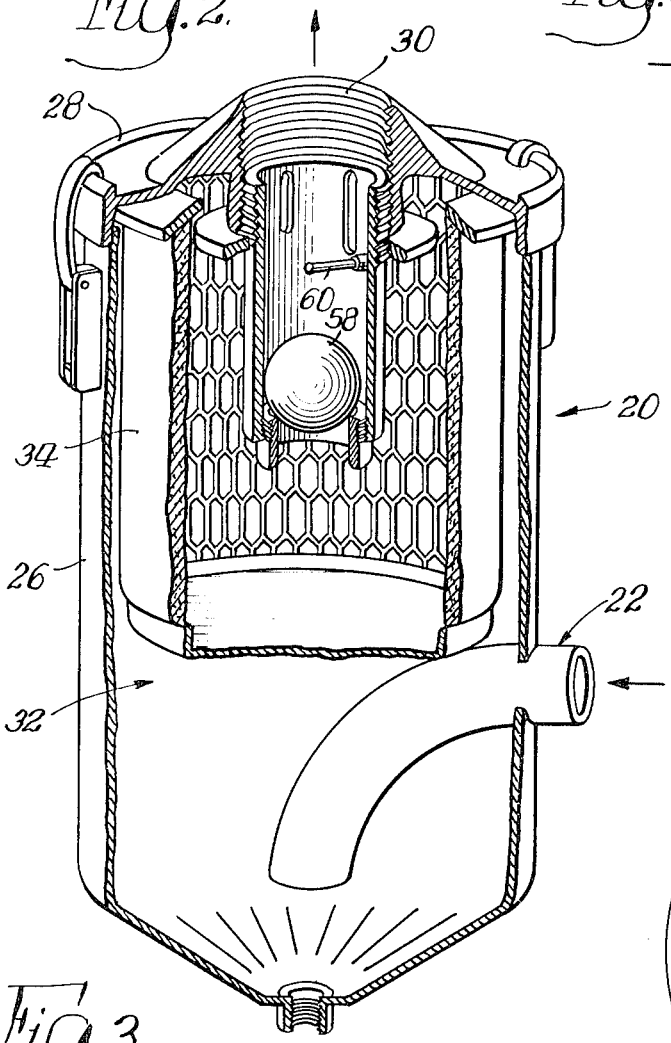
FIG. 2 is a perspective view, on an enlarged scale and with portions being broken away, of the filter unit incorporated in the crankcase ventilation system of FIG. 1, and shows one embodiment of control valve unit of the present invention.

Referring now to FIG. 2, the filter unit 20 comprises a container 26, and a removable cover member 28 in which is formed a threaded outlet opening 30. The container 26 and cover member 28 define a condensation filtration chamber 32, the inlet conduit means 22 projects into the chamber 32, and the outlet opening 30 has connection with the outlet conduit means 24. Suspended within the chamber 32 is an annular filter cartridge 34.

Figure 3:
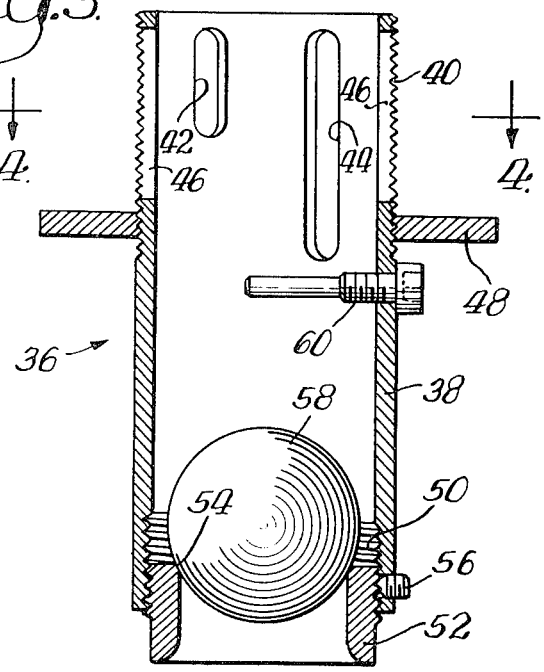
FIG. 3 is a vertical median sectional view, on a further enlarged scale, of the control valve unit of FIG. 2.
Figure 4:
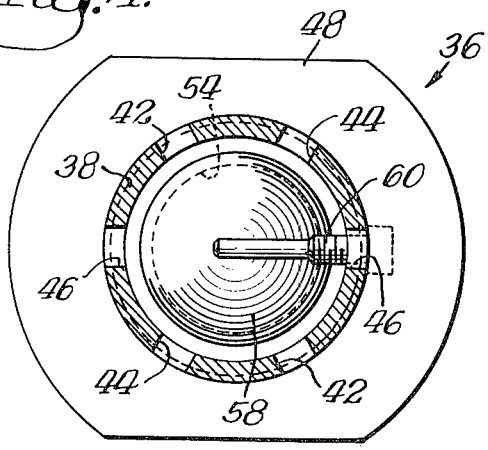
FIG. 4 is a horizontal sectional view taken substantially along the line 4—4 of FIG. 3 looking in the direction indicated by the arrows.

Mounted within the chamber 32 interiorly of the filter cartridge 34 is one embodiment of a volumetric control valve unit 36 incorporating the principles of the present invention. The control valve unit 36, as shown in FIGS. 2, 3 and 4, comprises a vertical tubular member 38 having an upper externally threaded portion 40 threaded in the threaded outlet opening 30. The tubular member 38, adjacent its upper end, is formed with a pair of short vertical slots 42, a pair of long vertical slots 44, and a pair of intermediate-length vertical slots 46. The tubular member 38 is rotatably adjustable within the outlet opening 30 whereby the area of the slots exposed to the condensation filtration chamber 32--that is, the effective metering area of the slots--may be selectively varied. The tubular member 38 is retained in any preselected position by a locking ring 48.

The lower end of the tubular member 38 is provided with an internally threaded portion 50, and threaded therein is an externally threaded ring member 52 defining a valve seat 54. The ring member 52 is secured in position by a set screw 56. Normally seated by gravity on the valve seat 54 within the tubular member 38 is a ball valve 58. The removable ring member 52 accommodates assembly of the ball valve 58 within the tubular member 38. Upward movement of the ball valve 58 is limited by a stop bolt 60 threaded through the side of the tubular member 38.

Operationally, in the "open" ventilation system shown in FIG. 1, fresh air is drawn into the crankcase 12 through the filter unit 18. The fresh air and crankcase vapors then pass from the crankcase 12 through the inlet conduit means 22 into the condensation filtration chamber 32 and through the sides of the filter cartridge 34. The vapors are suitably filtered by the cartridge 34; and tars, varnish and other non-combustible foreign materials are collected in the condensation filtration chamber 32. At this point, the control valve unit 36 meters the flow of filtered vapors between the interior of the filter cartridge 34 and the outlet opening 30. From the outlet opening 30, the vapors pass through the outlet conduit means 24 to the intake manifolds 14.

More specifically, the slots 42, 44 and 46 in the tubular member 38 provide first passageway means restricting the flow of vapors through the control valve unit 36. In this connection, the tubular member 38 is rotatably preadjusted within the outlet opening 30 so that the slots present a metering area corresponding to a predetermined value of negative pressure desired in the crankcase 12 under normal operating conditions. Additionally, when the pressure in the crankcase 12 exceeds the predetermined value of negative pressure--for example, as the result of excess crankcase emissions caused by wear of engine parts--, the ball valve 58 is unseated from the valve seat 54 thereby providing additional passageway means for the flow of vapors through the control valve unit 36. As will be appreciated, the operation of the ball valve 58 automatically compensates for changes in the pressure in the crankcase 12 and serves to maintain the pressure in the crankcase 12 substantially at the predetermined value.

Figure 5:
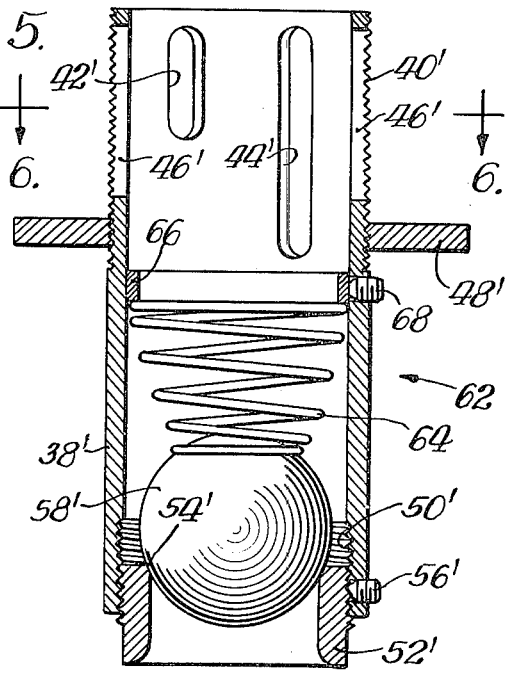
FIG. 5 is a vertical median sectional view of another embodiment of control valve unit of the present invention.
Figure 6:
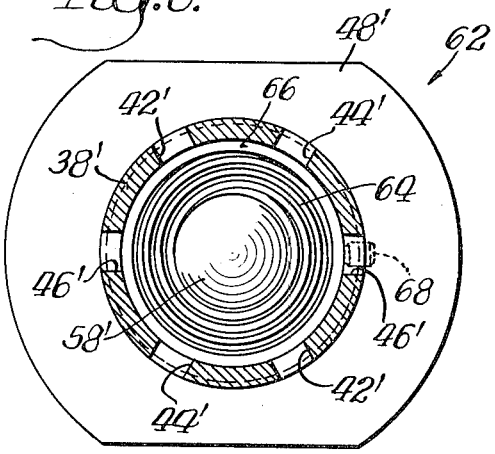
FIG. 6 is a horizontal sectional view taken substantially along the line 6—6 of FIG. 5 looking in the direction indicated by the arrows.

Referring now to FIGS. 5 and 6, there is shown a modified embodiment of control valve unit 62 incorporating the principles of the present invention. Primed reference numerals have been used to identify those parts of the control valve unit 62 which are identical or similar to the corresponding parts of the control valve unit 36. The control valve unit 62 includes a conical coil spring 64 arranged within the tubular member 38' between a base ring 66, held in place by a set screw 68, and the ball valve 58'. The spring 64 serves to bias the ball valve 58' into seating engagement with the valve seat 54'. The effective pressure of the spring 64 may be selectively varied by rotatably adjusting the ring member 52' in the tubular member 38'. The control valve unit 62 is especially adapted for use in a "closed" ventilation system wherein a slight positive pressure is present in the crankcase. The "closed" system is substantially the same as the "open" system shown in FIG. 1 with the exception that the fresh-air inlet filter unit 18 is absent and the side opening 16 is suitably closed. The control valve unit 62 establishes and maintains the pressure in the crankcase substantially at a predetermined desired value in substantially the same manner as the control valve unit 36.

While there has been shown and described preferred embodiments of the present invention, it will be understood by those skilled in the art that various rearrangements and modifications be made therein without departing from the spirit and scope of the invention.

The invention claimed is:

1. An internal combustion engine having a crankcase and an intake manifold, a filter unit defining a condensation filtration chamber and having an upper outlet opening, inlet conduit means accommodating the flow of vapors from the crankcase to the condensation filtration chamber, and outlet conduit means accommodating the flow of vapors from the outlet opening to the intake manifold: a volumetric control valve unit within the condensation filtration chamber for metering the flow of vapors between the condensation filtration chamber and the outlet opening comprising a vertical tubular member mounted at its upper end in the outlet opening, said tubular member being formed with slot means adjacent the upper end thereof to provide first passageway means restricting the flow of vapors through said control valve unit and presenting a metering area corresponding to a predetermined value of pressure desired in the crankcase under normal operating conditions, valve seat means adjacent the lower end of said tubular member, a ball valve within said tubular member and normally seated on said valve seat means, and said ball valve being unseated from said valve seat means when the pressure in the crankcase exceeds said predetermined value of pressure to provide additional passageway means for the flow of vapors through said control valve unit.

2. The control valve unit of claim 1 wherein said upper end of said tubular member is threaded in the outlet opening, and said tubular member is rotatably adjustable in the outlet opening whereby the effective metering area of said first passageway means may be selectively varied.

3. The control valve unit of claim 2 wherein said slot means comprises a plurality of circumferentially spaced apart vertical elongated slots of various lengths.

4. The control valve unit of claim 3 including spring means within said tubular member and serving to bias said ball valve into seating engagement with said valve seat means.

5. The control valve unit of claim 4 wherein said valve seat means comprises a ring member threaded in the lower end of said tubular member, and said ring member is rotatably adjustable in said tubular member whereby the effective pressure of said spring means may be selectively varied.

6. The control valve unit of claim 1 including spring means within said tubular member and serving to bias said ball valve into seating engagement with said valve seat means.

7. The control valve unit of claim 6 wherein said valve seat means comprises a ring member threaded in the lower end of said tubular member, and said ring member is rotatably adjustable in said tubular member whereby the effective pressure of said spring means may be selectively varied.

* * * * *